US012151285B2

(12) United States Patent
Opdendries et al.

(10) Patent No.: US 12,151,285 B2
(45) Date of Patent: Nov. 26, 2024

(54) MOLD CORNER HEATING DURING CASTING

(71) Applicant: NOVELIS INC., Atlanta, GA (US)

(72) Inventors: Brent Opdendries, Post Falls, ID (US); Robert Bruce Wagstaff, Greenacres, WA (US); Ravindra Tarachand Pardeshi, Kennesaw, GA (US); Samuel Robert Wagstaff, Marietta, GA (US)

(73) Assignee: Novelis Inc., Atlanta, GA (US)

( * ) Notice: Subject to any disclaimer, the term of this patent is extended or adjusted under 35 U.S.C. 154(b) by 0 days.

(21) Appl. No.: 17/905,535

(22) PCT Filed: Feb. 26, 2021

(86) PCT No.: PCT/US2021/070201
§ 371 (c)(1),
(2) Date: Sep. 2, 2022

(87) PCT Pub. No.: WO2021/189067
PCT Pub. Date: Sep. 23, 2021

(65) Prior Publication Data

US 2023/0118847 A1 Apr. 20, 2023

Related U.S. Application Data

(60) Provisional application No. 62/992,610, filed on Mar. 20, 2020.

(51) Int. Cl.

| | |
|---|---|
| ***B22D 27/02*** | (2006.01) |
| ***B22D 7/06*** | (2006.01) |
| ***B22D 11/00*** | (2006.01) |

(52) U.S. Cl.
CPC ..... *B22D 27/02* (2013.01); *B22D 7/06* (2013.01); *B22D 11/003* (2013.01)

(58) Field of Classification Search
CPC ..... B22D 7/06; B22D 11/00; B22D 11/003; B22D 11/049; B22D 11/11; B22D 11/115; B22D 27/02
(Continued)

(56) References Cited

U.S. PATENT DOCUMENTS

2015/0034269 A1* 2/2015 Tanahashi et al. .. B22D 11/145 164/467

FOREIGN PATENT DOCUMENTS

| | | |
|---|---|---|
| CN | 203639530 U | 6/2014 |
| CN | 107073573 A | 8/2017 |

(Continued)

OTHER PUBLICATIONS

PCT/US2021/070201 , "International Preliminary Report on Patentability", Sep. 29, 2022, 10 pages.

(Continued)

*Primary Examiner* — Kevin P Kerns
(74) *Attorney, Agent, or Firm* — Kilpatrick Townsend & Stockton LLP

(57) ABSTRACT

Systems and methods may utilize magnetic rotors to heat molten metal in the corner regions of a mold during casting (e.g., casting of an ingot, billet, or slab). The magnetic rotors are positioned adjacent to the corners of the mold and heat the molten metal in the corner region to increase the temperature of the molten metal adjacent the corners. The increased temperature of the molten metal in the mold corners can prevent intermetallics from forming in the molten metal or otherwise reduce such formation.

15 Claims, 6 Drawing Sheets

(58) Field of Classification Search
USPC ..... 164/48, 498, 499, 146, 147.1, 466, 467, 164/468, 502, 503, 504
See application file for complete search history.

(56) References Cited

FOREIGN PATENT DOCUMENTS

| | | | |
|---|---|---|---|
| CN | 209322988 | U | 8/2019 |
| GB | 2079195 | A | 1/1982 |
| JP | 11123511 | A | 5/1999 |
| JP | 2017515687 | | 6/2017 |
| RU | 2092593 | C1 | 10/1997 |
| RU | 2230823 | C2 | 6/2004 |
| WO | 2015179677 | A1 | 11/2015 |

OTHER PUBLICATIONS

PCT/US2021/070201 , "International Search Report and the Written Opinion", May 21, 2021, 13 pages.
RU2022122363 , "Office Action", Mar. 7, 2023, 14 pages.
EP21713323.0 , "Office Action", Aug. 14, 2023, 7 pages.
JP2022-549324 , "Office Action", Oct. 3, 2023, 4 pages.
CA3,169,612 , "Office Action", Aug. 10, 2023, 4 pages.
RU2022122363 , "Notice of Decision to Grant", Jun. 20, 2023, 15 pages.
EP21713323.0, "Intention to Grant", Apr. 19, 2024, 9 pages.
JP2022-549324, "Office Action", Mar. 5, 2024, 5 pages.
KR10-2022-7028686, "Office Action", Oct. 25, 2023, 4 pages.
CN202180022296.5 "Office Action", May 1, 2024, 21 pages.
KR10-2022-7028686, "Notice of Decision to Grant", Jun. 4, 2024, 4 pages.

* cited by examiner

MOLD CORNER HEATING DURING CASTING

CROSS-REFERENCE TO RELATED APPLICATION

This application is a national stage application of International Application PCT/US2021/070201, filed on Feb. 26, 2021, and titled MOLD CORNER HEATING DURING CASTING, which claims the benefit of and priority to U.S. Provisional Application No. 62/992,610, filed on Mar. 20, 2020, and titled MOLD CORNER HEATING DURING CASTING, both of which are herein incorporated by reference in their entireties for all purposes.

FIELD

The present disclosure relates to metallurgy generally and more specifically to improved mold corner heating during casting.

BACKGROUND

In the metal casting process, molten metal is passed into a mold cavity. For some types of casting, mold cavities with false, or moving, bottoms are used. As the molten metal enters the mold cavity, generally from the top, the false bottom lowers at a rate related to the rate of flow of the molten metal. The molten metal that has solidified near the sides can be used to retain the liquid metal and partially liquid metal in the molten sump. Metal can be 99.9% solid (e.g., fully solid), 100% liquid, and anywhere in between. The molten sump can take on a V-shape, U-shape, or W-shape, due to the increasing thickness of the solid regions as the molten metal cools. The interface between the solid and liquid metal is sometimes referred to as the solidifying interface.

In direct chill casting, water or other coolant is used to cool the molten metal as the metal solidifies into a metal ingot as the false bottom of the mold cavity lowers. The coolant can create a temperature gradient in the molten metal, with the molten metal near the mold walls having a lower temperature than the molten metal near the center of the mold. The cooler molten metal near the mold walls can form microstructures in the solidifying metal that can remain in the resulting metal ingot. These microstructures can result in defects in the ingot, for example, when the metal ingot is rolled. Removing these defects from the metal ingot can result in lost time and material.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Certain examples herein address systems and methods for generating heat in molten metal in a mold to prevent or reduce intermetallics from forming in the molten metal. Various examples utilize a mold having an opening formed by multiple sidewalls to receive and contain the molten metal. One or more magnetic rotors can be positioned above the mold in a corner region formed by the meeting of two or more of the sidewalls. The two or more sidewalls can meet and form a curved corner with a radius. In some cases, the magnetic rotor may have a radius that allows the magnetic rotor to be positioned near the corner radius of the mold. For example, the curvature of the magnetic rotor may match the curvature at the corner radius of the mold. The magnetic rotors can generate heat in the molten metal by inducing changing magnetic fields in the molten metal. Inducing changing magnetic fields in the molten metal can create flow and electric current (e.g., eddy currents) in the molten metal to heat the molten metal. The one or more magnetic rotors may be configured to heat the molten metal of the molten metal in the corner region to a temperature above which intermetallics can form (e.g., above 515 degrees Celsius for a 3104 alloy or a similarly desired temperature for other alloys to avoid forming melting intermetallics). The magnetic rotor positioned near the corner radius of the mold can localize the heating of the molten metal to a region directly adjacent to the mold wall at the corner radius (e.g., in a region that extends from the interior face of the corner radius to approximately 50 mm from the interior face of the corner radius). The magnetic rotor can be positioned and otherwise configured so the localized heating has little or no effect on the molten metal at or near the center of the mold, or away from the corners of the mold. The increase of the temperature above the temperature at which intermetallics can form can prevent or otherwise reduce formation of the intermetallics in the molten metal, for example, in the region adjacent to the corner radius.

In various examples, an apparatus is provided. The apparatus may include a mold and a magnetic rotor. The mold may have mold walls defining an opening for accepting molten metal. The mold walls may intersect to at least partially define a corner region of the opening. The magnetic rotor may be positioned adjacent to the corner region at a height above the molten metal when the molten metal is within the opening. The magnetic rotor may heat and induce a temperature increase in the molten metal within the corner region sufficient to prevent or otherwise reduce formation of the intermetallics in the molten metal at the corner region.

In various examples, a system is provided. The system may include a mold, a motor, and a magnetic source. The mold may have two or more sidewalls defining an opening for accepting molten metal. The two or more sidewalls may further define a corner region. The motor may be coupled with a drive shaft and positioned above the molten metal and adjacent to the corner region. The motor may rotate the drive shaft. The magnetic source may be coupled with the drive shaft and configured to induce heating of the molten metal adjacent to the corner region when rotated.

In various examples, a method is provided. The method may include depositing molten metal into a mold opening defined by two or more mold walls that may further define at least one corner region. Heat may be generated in the molten metal adjacent to the corner region by operating at least one magnetic rotor positioned adjacent to the corner region and above the molten metal. A temperature increase may be induced in the molten metal adjacent to the corner region sufficient to prevent or otherwise reduce formation of the intermetallics in the molten metal. The temperature increase may be caused by at least the heat generated by operating the at least one magnetic rotor.

Other objects and advantages will be apparent from the following detailed description of non-limiting examples.

BRIEF DESCRIPTION OF THE FIGURES

The specification makes reference to the following appended figures, in which use of like reference numerals in different figures is intended to illustrate like or analogous components.

DETAILED DESCRIPTION

Figure 1:
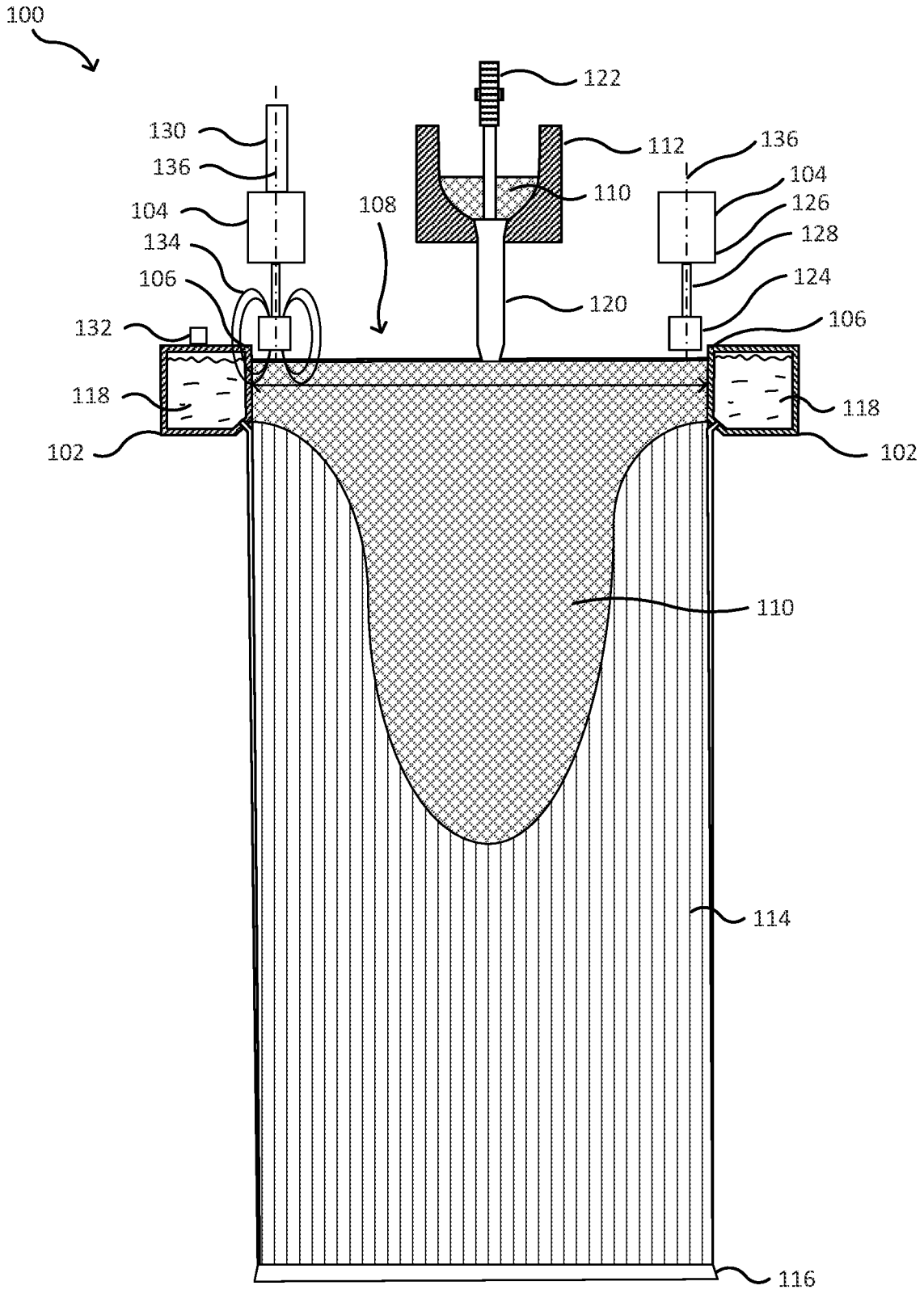
FIG. 1 is a partial cut-away view of a metal casting system including a mold with magnetic rotors in a vertical orientation according to various embodiments.

The following examples will serve to further illustrate the present invention without, at the same time, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention.

In this description, reference is made to alloys identified by AA numbers and other related designations, such as "series." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

In traditional casting techniques for casting metal ingots, molten metal can be deposited into a mold through a mold opening. The molten metal can at least partially fill the mold and begin to cool, forming a metal ingot. The molten metal can cool at different rates; for example, the molten metal closer to the mold walls can cool at faster rate than the molten metal near the center of the mold. The difference in cooling rates can cause metal oxide layers to form in, on, or near the exterior layers of the ingot, for example, at or near the corners of the mold. During further processing operations of the ingot, for example, scraping and/or rolling of the ingot, the metal oxide layers can grow and/or separate from the ingot, leading to additional waste and/or processing.

In embodiments herein, systems and techniques relating to one or more magnetic rotors heating molten metal near the corners of a mold are described. The magnetic rotors can be positioned near the corner joints of the mold at a height above the molten metal. The magnetic rotors can rotate and induce moving or time varying magnetic fields within the molten metal in the mold corner. The changing magnetic fields can create eddy currents within the molten metal. The eddy currents can heat the molten metal by inducing metal flow in the mold corner and cause the temperature of the molten metal near the corner joints to increase to a temperature above the temperature at which intermetallics can form in the molten metal. As a result, intermetallics can be prevented from forming or the formation of intermetallics can otherwise be reduced near the corners of the ingot. Preventing intermetallics from forming or otherwise reducing such formation can save time and material during processing operations performed on the metal ingot (e.g., scraping and rolling operations). In some examples, the magnetic rotors can be positioned and otherwise configured so the localized heating has little or no effect on the molten metal at or near the center of the mold, or away from the corners of the mold.

Turning now to exemplary embodiments, FIG. 1 is a partial cut-away view of a metal casting system 100 including a mold 102 with magnetic rotors 104 in a vertical orientation (e.g., the rotation axis 136 of the magnetic rotors 104 is perpendicular to the top face of the mold). The mold 102 can form or define a mold opening 108 for receiving molten metal 110, for example, from a launder 112 or other molten metal supply source. The magnetic rotors 104 can be positioned at or near the corner joints of the mold 102 and heat the molten metal 110, increasing the temperature of the molten metal in the mold above a temperature at which intermetallics can form.

The mold 102 can receive the molten metal 110 from the launder 112, which can be positioned near the mold 102. For example, the launder 112 may be positioned above the mold 102 and deposit molten metal into the mold opening 108 through a feed tube 120. The launder 112 may include a flow control device 122 for adjusting the flow rate of the molten metal 110 from the launder 112 to the mold opening 108.

In various embodiments, the mold 102 can include mold walls 106 (e.g., sidewalls), that define the mold opening 108 for receiving the molten metal 110. The mold opening 108 can be a rectangular opening (e.g., a shape having two pairs of parallel sidewalls meeting at right angles) having one or more quadrants for receiving molten metal 110. However, the mold opening 108 may be any suitable shape (e.g., circular or triangular). In various embodiments, the mold opening 108 can have rounded edges each having a rounded interior face. The mold walls 106 can be or include material that can withstand exposure to molten metal 110 and form the molten metal into various shapes and forms. A bottom block 116 can be positioned near the mold walls 106 to receive the molten metal 110 passing through the mold opening 108. For example, prior to depositing molten metal 110 into the mold opening 108, the bottom block 116 may be lifted to meet the mold walls 106. Molten metal 110 can be deposited into the mold 102 and begin to cool, forming solidifying metal 114. As the solidifying metal 114 begins to form within the mold 102, the bottom block 116 can be steadily lowered, for example, by an actuator and/or telescoping hydraulic table. The solidifying metal 114 can form a casing around the molten metal 110. As molten metal 110 is added to the top of the mold 102, the bottom block 116 can continue to lower, continuously lengthening the solidifying metal 114. In various embodiments, the mold walls 106 may include cooling elements to aid in the forming of solidifying metal 114. For example, the mold walls 106 can define a hollow space containing a coolant 118, such as water or glycol or other suitable coolant. The coolant 118 can exit from one or more of the mold walls 106 and flow down the sides of the solidifying metal 114 (e.g., from the mold 102 towards the bottom block 116).

In various embodiments, one or more metal level sensors 132 can be positioned on or around the mold 102 to measure the height of the molten metal 110 and/or the solidifying metal 114 in the mold. In some cases, the structure and operation of the metal level sensor 132 is conventional. Other non-limiting options for the metal level sensor 132 may include a float and transducer, a laser sensor, or another type of fixed or movable fluid level sensor having desired properties for accommodating molten metal. In various embodiments the metal level sensors 132 may be coupled with one or more thermocouples and/or one or more infrared detection devices. The metal level sensors 132, thermocouples, and/or infrared detection device may be used to create a closed-loop automation system to detect and/or react to unbalanced thermal conditions.

One or more magnetic rotors 104 can be can be positioned near the mold walls 106 for example, near the corners of the mold 102. The magnetic rotors 104 can be positioned to heat the molten metal 110 received in the mold 102. For example, a magnetic rotor 104 can be positioned in a corner region of the mold 102 to heat the molten metal 110 in and/or near the corner region. The magnetic rotors 104 can generate heat in the molten metal 110 by generating eddy currents that generate heat and induce flow in the molten metal. The magnetic rotors 104 can be sized and shaped so they are able to be positioned up against or adjacent a corner of the mold 102. For example, when the corner of the mold 102 is rounded, the magnetic rotors 104 can have a circular cross section with a radius that matches the radius of the corner of the mold 102. The circular cross section of the magnetic rotors 104 positioned adjacent to the rounded corner of the mold 102 can localize the effect of the magnetic rotors on the molten metal 110 such that the effect is wholly or partially contained within the corner region.

The magnetic rotors 104 can heat the molten metal 110 by inducing changing magnetic fields 134 (moving or time varying magnetic fields) within the molten metal 110 proximate the magnetic rotor 104. The changing magnetic fields 134 create eddy currents within the molten metal 110 that generate heat and induce flow of the molten metal into the corner of the mold (shown in FIG. 6). The eddy currents and induced flow can heat and/or keep (e.g., balance the thermal conditions of the molten metal 110) at a temperature that prevents or otherwise reduces intermetallics from forming in the molten metal. The thermal conditions of the molten metal 110 can be balanced such that the Peclet and Biot numbers are balanced (e.g., the same amount of heat is supplied to the molten metal as is being extracted by the mold 102 at the corners). The molten metal 110 can be heated to and/or kept at a temperature that prevents or otherwise reduces intermetallics from forming in the molten metal and/or prevents the solidifying metal 114 from pulling away (e.g., freezing back) from the mold walls 106. For example, when the molten metal 110 is a 3104 alloy, the eddy currents can heat and/or keep the molten metal at a temperature above 515 degrees Celsius. The heating and maintaining of the molten metal 110 above the intermetallic formation temperature can prevent intermetallics from forming in the solidifying metal 114 and/or prevent the solidifying metal 114 from pulling away from the mold 102 and causing stress concentrations. The magnetic rotors 104 may heat and/or keep the molten metal 110 at a temperature in the range of approximately 515 degrees Celsius to 1000 degrees Celsius (such as 515 degrees, 600 degrees, 700 degrees, 800 degrees, 1000 degrees, or any value in between).

The magnetic rotors 104 can be positioned and/or oriented to localize the eddy currents (and the induced flow) in the molten metal 110. For example, the magnetic rotors 104 may be positioned to generate eddy currents in a corner region of the mold 102 that generates heat and induces flow in the molten metal causing hot molten metal (e.g., at a temperature above the formation temperature of the intermetallics) to flow into the corners of the mold 102.

The magnetic rotors 104 can be or include magnetic rotors that are positioned above the molten metal 110 at the corners of the mold 102 and can heat the molten metal without contacting the molten metal (e.g., non-contact magnetic rotors). However, the magnetic rotors 104 may be or include magnetic rotors that contact the surface of the molten metal 110 (e.g., contact magnetic rotors) and/or magnetic rotors that have at least a portion that is positioned beneath the surface of the molten metal (e.g., submergible magnetic rotors). The magnetic rotors 104 may additionally or alternatively include electromagnets, a heating element, and/or any device suitable for heating the molten metal 110.

The magnetic rotors 104 may be suspended above the mold 102 using one or more of wires, chains, or other suitable devices. In various embodiments, the magnetic rotors 104 can be coupled to the launder 112 positioned above the mold 102 and/or coupled to the mold 102 itself. The magnetic rotors 104 can be suspended above the mold 102 to position a portion of the magnetic rotors in the range of 0.5 mm to 20 mm above the surface of the molten metal 110.

The magnetic rotors 104 can be or include a rotation mechanism 126 and one or more magnets 124. The magnetic rotors 104 can be rotated at various speeds, for example, at a speed in the range between 60 revolutions per minute (RPM) and 600 RPM. In various embodiments, the magnetic rotors 104 can be rotated at a speed that maximizes the heating of the molten metal 110 in the corner region. For example, the magnetic rotors 104 may be rotated at 180 RPM (3 Hz). The magnets can be or include permanent magnets, electromagnets, or any suitable magnetic device. The rotation mechanism 126 can be coupled with the magnets 124 to cause rotation of the magnets 124. The rotation mechanism 126 can be or include a fluid motor that rotates the magnets 124 using a coolant fluid, such as air, allowing the same fluid to both cool the rotation mechanism and cause rotation of the magnetic source, for example, with a turbine or impeller. The rotation mechanism 126 may additionally or alternatively be or include an electric motor, fluid motors (e.g., hydraulic or pneumatic motors), adjacent magnetic fields (e.g., using an additional magnet source to induce rotation of the magnets of the magnetic source), or any suitable rotation mechanism.

In various embodiments, the magnetic rotors 104 can include an axle 128 connecting the rotation mechanism 126 with the magnets 124. The magnets 124 can be rotationally fixed to the axle 128 (e.g., the permanent magnets rotate at the same speed as the axle) or the permanent magnets may be free to rotate with respect to the axle 128 (e.g., the permanent magnets can rotate around the center axle). The magnetic rotors 104 may additionally or alternatively rotate around a rotation axis 136. The rotation axis 136 can be generally perpendicular to a top face of the mold 102 (e.g., the magnetic rotors 104 are oriented in the vertical orientation). However, the magnets 124 may be rotated in any suitable orientation (e.g., the permanent magnets are rotated around a rotation axis 136 that is positioned at any suitable angle relative to the mold 102, including so the magnetic rotors 104 are oriented in the horizontal direction). In some embodiments, the axle 128 may act as the rotation axis 136.

Figure 2:
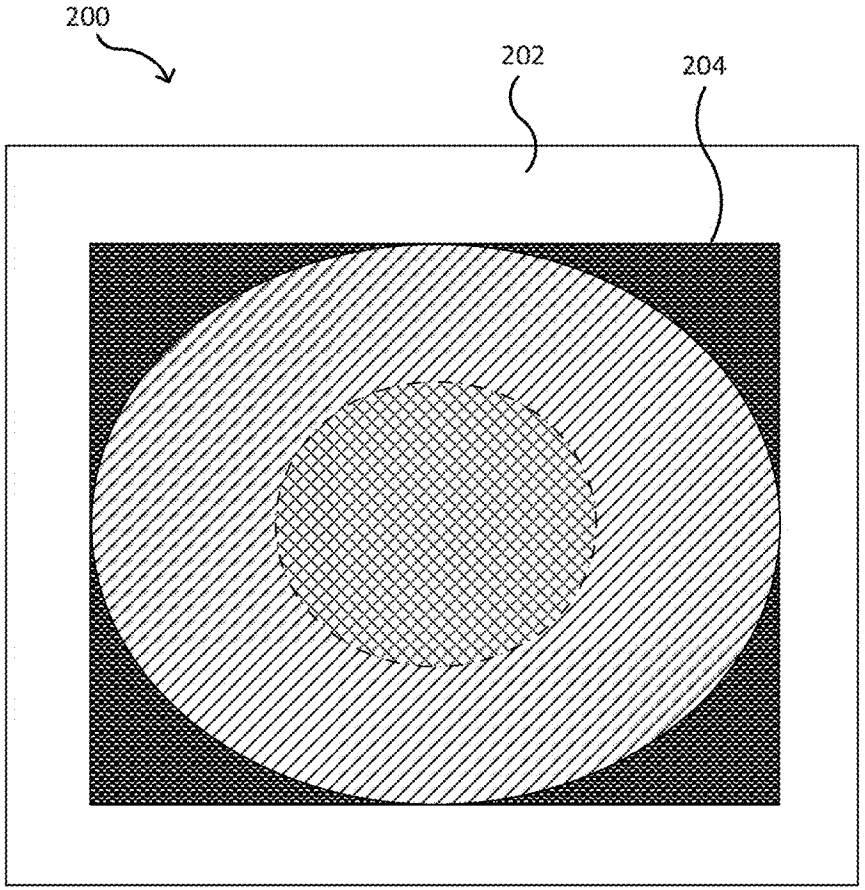
FIG. 2 (prior art)
FIG. 2 is top view of a known metal casting system without magnetic rotors.

Turning to FIG. 2, a top view of a temperature profile of molten metal 204 in a known metal casting system 200 without magnetic rotors 104 is shown. The molten metal 204 located near the corners of the mold 202 has a lower temperature than the molten metal located near the center of the mold (e.g., depicted graphically in FIG. 2 by different types of shading). For example, the molten metal located near the mold walls can be at a temperature below 515 degrees Celsius and the temperature of the molten metal located near the center of the mold 202 can be at a temperature above 590 degrees Celsius. The lower temperature (e.g., below 515 degrees Celsius) of the molten metal 204 at the corners can be caused by heat being extracted from the molten metal by the two walls that form the corner. The extracting of the heat from the molten metal 204 can disrupt the balance of the Biot and Peclet numbers (i.e., more heat is extracted than supplied) and reduce the temperature of the molten metal 204 at the corners. The lower temperature of the molten metal 204 at the corners can allow an intermetallic layer to form in the molten metal 204 and/or a portion of the molten metal to solidify and retract away from the mold 202. More specifically, the meniscus of the molten metal 204 can retract from the corners and freeze back; as the metal level increases, the meniscus builds further until the surface tension is broken and the metal can roll over the pre-frozen corner region, resulting in stress concentrations. The intermetallics and/or the stress concentrations can remain in the metal ingot formed by the metal casting system 200, for example, beneath an oxide layer.

Figure 3:
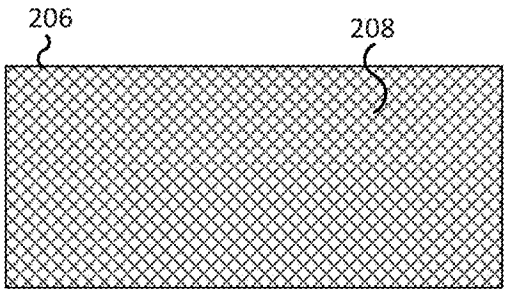
FIG. 3 (prior art)
FIG. 3 is a top view of a metal ingot formed using the known metal casting system without magnetic rotors of FIG. 2.

FIGS. 3 through 6 are illustrations of a known metal ingot 206 formed using the metal casting system 200 without magnetic rotors 104. FIGS. 3-6 show a single face of the metal ingot 206, however, the metal ingot may contain any number of faces. For example, the metal ingot 206 may be a rectangular prism with six faces. FIG. 3 shows one face of the metal ingot 206 having an oxide layer 208. Although only one face of the metal ingot 206 is shown having an oxide layer 208, the oxide layer can cover some or all of the faces of the ingot.

Figure 4:
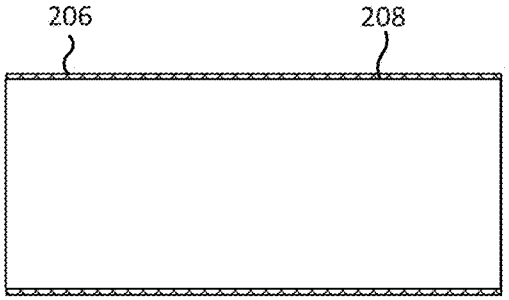
FIG. 4 (prior art)
FIG. 4 is a top view of the metal ingot of FIG. 3 after processing techniques have been performed on the ingot.

As shown in FIG. 4, some or all of the oxide layer 208 can be removed from the metal ingot 206, for example, by scraping or scalping the ingot. Removing the oxide layer 208 through scraping or scalping can leave some oxide layer on the edges of the metal ingot 206 where two or more of the metal ingot faces meet. The intermetallics formed during the casting process can be located within the metal ingot 206 beneath the intact oxide layer on the edges of the metal ingot 206.

After removal of the oxide layer 208, various rolling operations (e.g., hot rolling or cold rolling) can be performed on the metal ingot 206. The temperature of the rolling operations can be performed at or cause the temperature of the metal ingot 206 to rise to a temperature above the melting temperature of the intermetallics and below the melting point of the metal ingot 206, causing the intermetallics located beneath the oxide layer 208 to melt while the rest of the metal ingot remains intact. For example, the intermetallics can have a melting temperature of 515 degrees Celsius and the hot rolling temperature can be 550 degrees Celsius, causing the intermetallics in the metal ingot to melt while the other metal in the ingot remains solid on account of not exceeding a corresponding melting point of 575 degrees Celsius.

Figure 5:
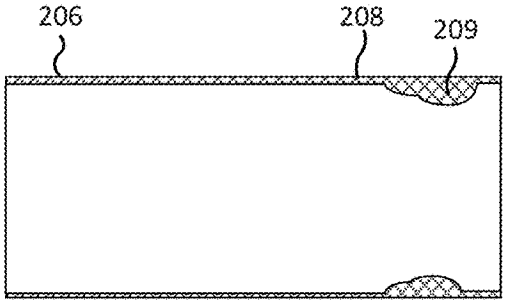
FIG. 5 (prior art)
FIG. 5 is a top view of the metal ingot of FIG. 4 after rolling techniques have been performed on the ingot.

As shown in FIG. 5, the melting of the intermetallics can cause a portion of the oxide layer 208 to separate from the metal ingot 206 and migrate from an edge to a face of the metal ingot. For example, the oxide layer 208 can be forced from the edge of the metal ingot 206 to a face of the metal ingot during the rolling operations. As shown in FIG. 5, a portion of the oxide layer 208 can move from the edge of the face toward the center of the face and form what may be called a sliver 209 on the face of the ingot. The oxide layer 208 on the face of the metal ingot 206 can result in additional processing operations (e.g., additional scalping and/or scraping operations) being performed on the metal ingot, which can result in additional processing time and/or additional material waste.

Figure 6:
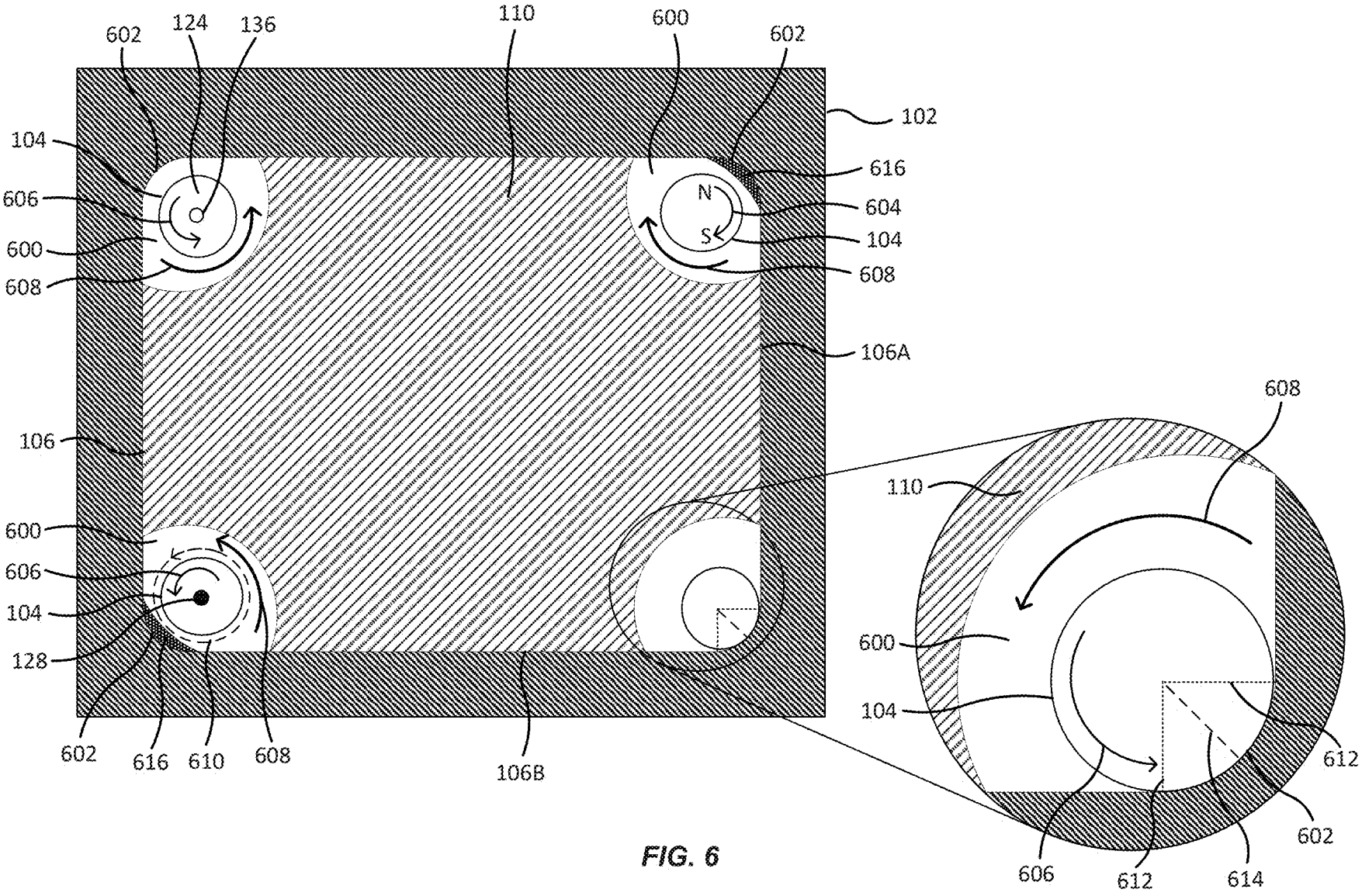
FIG. 6 is a top view of the mold and magnetic rotors of FIG. 1, according to various embodiments.

Turning now to FIG. 6, a top view of the mold 102 and magnetic rotors 104 of FIG. 1 is shown, according to various embodiments. As shown, the exterior of the mold walls 106 can have a rectangular cross-section and the interior of the mold walls 106 can form a generally rectangular cross section with four rounded corners. The corners can each have a corner region 600 with one or more magnetic rotors 104 positioned above the corner region. However, the mold 102 may have any number of mold walls 106 forming any suitable cross-section and/or any number of magnetic rotors 104 positioned around the mold.

One or more of the rounded corners of the mold walls 106 can have a rounded interior face 602 oriented towards the center of the mold 102. The rounded interior face 602 can have a radius 612. The radius 612 can be sized and shaped to receive the magnetic rotors 104. For example, at least one of the magnetic rotors 104 can have a circular cross-section with a radius 614 that matches the radius 612 of one or more of the corners of the mold 102. The radius 614 and corresponding radius 612 can allow the magnetic rotor 104 to be positioned as close to the mold walls 106 as possible, while still being positioned above the molten metal 110. For example, the rounded interior face 602 and the magnetic rotor 104 can be coaxial. The position of the magnetic rotor 104 can increase the effect of the magnetic rotor on the molten metal 110 in the corner region 600, for example, by localizing the heating and/or the flow effect in the corner region.

The corner region 600 can stretch from one mold wall 106 to another mold wall. For example, the corner region 600 can arc from a first mold wall 106A to a second mold wall 106B. The corner region 600 can have an area that is larger than the area of a cross-section of the magnet rotors 104. However, the corner region 600 may have an area smaller than the area of a cross-section of the magnetic rotors 104 positioned next to the molten metal 110.

In some embodiments, the corner region 600 can include a contact region 616. The contact region 616 can be the molten metal 110 that is in contact with one or more of the mold walls 106. In traditional molds without magnetic rotors 104, the contact region 616 can be the region where intermetallics form.

The magnetic rotors 104 can be positioned and operated to localize heating of the molten metal 110 at or near the corner region 600 and/or the contact region 616. The magnetic rotors 104 can increase or keep the temperature of the molten metal in the corner region 600 above 550 degrees Celsius. For example, the magnetic rotors 104 can rotate to create a flow 608 of hotter molten metal 110 (e.g., molten metal at a temperature above the formation temperature of intermetallics) to the corner regions 600.

The magnetic rotors 104 can be optimized to partially or wholly localize the effect of the magnetic rotors at the corner region 600. For example, the magnetic rotors 104 can increase or keep the temperature of the molten metal 110 in the corner region 600 by inducing magnetic fields that generate eddy currents in the molten metal. The eddy currents can generate heat and induce flow in the molten metal causing molten metal to flow into the corner region. In various embodiments, the effect of the magnetic rotors 104 can be further localized to be wholly or partially within the contact region 616. For example, the magnetic rotors 104 may increase or keep the temperature of the molten metal in the corner region 600 above 515 degrees or other temperature that prevents intermetallics from forming in the corner region 600.

In various embodiments, the magnetic rotors 104 can be moved to various positions above the molten metal 110 in the mold 102. For example, a single magnetic rotor 104 may be moved to each of the corners to keep the temperature at all the corners above the temperature at which intermetallics form (e.g., approximately 515 degrees Celsius). In further embodiments, the magnetic rotors 104 may be moved to positions outside of the mold 102, such that the rotors are positioned outside of the mold walls 106. The magnetic rotors 104 may additionally or alternatively be moved between positions above the molten metal 110 and positions outside of the mold walls 106, including, but not limited to positions over the mold walls.

In some embodiments, the magnetic rotors can be coupled to a height adjustment mechanism 130 (FIG. 1, at left) that can be used to raise and lower the magnetic rotors 104 with respect to the mold 102. The axle 128 may additionally or alternatively be or include the height adjustment mechanism 130. During the casting process, it may be desirable to maintain a constant distance between the magnets 124 and the upper surface of the molten metal 110. The height adjustment mechanism 130 can adjust the height of the magnets 124 in response to the raising or lowering of the molten metal 110. For example, the height adjustment mechanism 130 can be connected to and/or coupled with the metal level sensor 132 to receive the height of the molten metal 110 and adjust the height of the magnets 124 based on the received height. The height adjustment mechanism 130 can be any mechanism suitable for adjusting the distance between the magnets 124 and the upper surface of the molten metal 110, for example, an actuator.

The magnetic rotors 104 can heat the molten metal 110 by rotating one or more magnets 124 around the rotation axis 136 to generate a changing magnetic fields 134. The changing magnetic fields 134 can induce current 610 in the molten metal 110. The induced current 610 can generate heat and induce flow in the molten metal 110. The one or more magnets 124 can be positioned in a range between 0.5 mm and 20 mm away from the surface of the molten metal 110. The magnetic rotors 104 can rotate the magnets 124 around a rotational or rotation axis 136 that is generally perpendicular to a top face of the mold 102 (e.g., the magnetic rotors 104 are oriented in the vertical orientation). The magnets rotated by the magnetic rotors 104 oriented in the vertical orientation can focus the heating effect of the magnetic rotors at the corner regions 600 and/or the contact regions 616 as described above. For example, in the vertical orientation, the magnetic rotors 104 can localize the heat generation to raise the temperature of the molten metal 110 in the corner regions 600 and/or the contact regions 616 above 515 degrees Celsius (or other suitable temperature for avoiding the formation of intermetallics) with minimal or no temperature increase to the molten metal outside of the corner regions 600.

The induced current 610 and resulting flow 608 and heat generation in the molten metal 110 can be controlled by controlling the magnetic rotors 104 to rotate the magnets 124 in various directions and/or at various speeds (e.g., the magnitude and/or direction or rotation can be adjusted). For example, the magnetic rotors can be rotated in a clockwise direction 604 or a counterclockwise direction 606. The magnetic rotors 104 can all rotate in the same direction (e.g., the magnetic rotors can rotate clockwise 604) or the magnetic rotors may rotate in multiple directions (e.g., a first magnetic rotor may rotate in a clockwise direction 604 and a second magnetic rotor may rotate in a counterclockwise direction 606).

The magnetic rotors 104 can be rotated at a speed in the range of approximately 100 revolutions per minute (RPM) to approximately 400 RPM, which is equivalent to approximately 1.67 Hz to approximately 6.67 Hz. However, the magnetic rotors 104 may rotate at a suitable speed in the range of 10-1000 RPM (such as 10 RPM, 25 RPM, 50 RPM, 100 RPM, 200 RPM, 300 RPM, 400 RPM, 500 RPM, 750 RPM, 1000 RPM, or any value in between). In some embodiments, the speed of rotation of the magnetic rotors 104 can be optimized to localize the effect of the molten metal 110 at the corner regions. For example, the magnetic rotors 104 can rotate at or around 180 RPM to keep or heat the molten metal 110 in the corner regions 600 above a temperature at which intermetallics form (e.g., 515 degrees Celsius for some alloys). As discussed further in reference to FIGS. 8A through 8C, the rotational speed of the magnetic rotors 104 can affect how much intermetallics are able to form in the corners.

Figure 7:
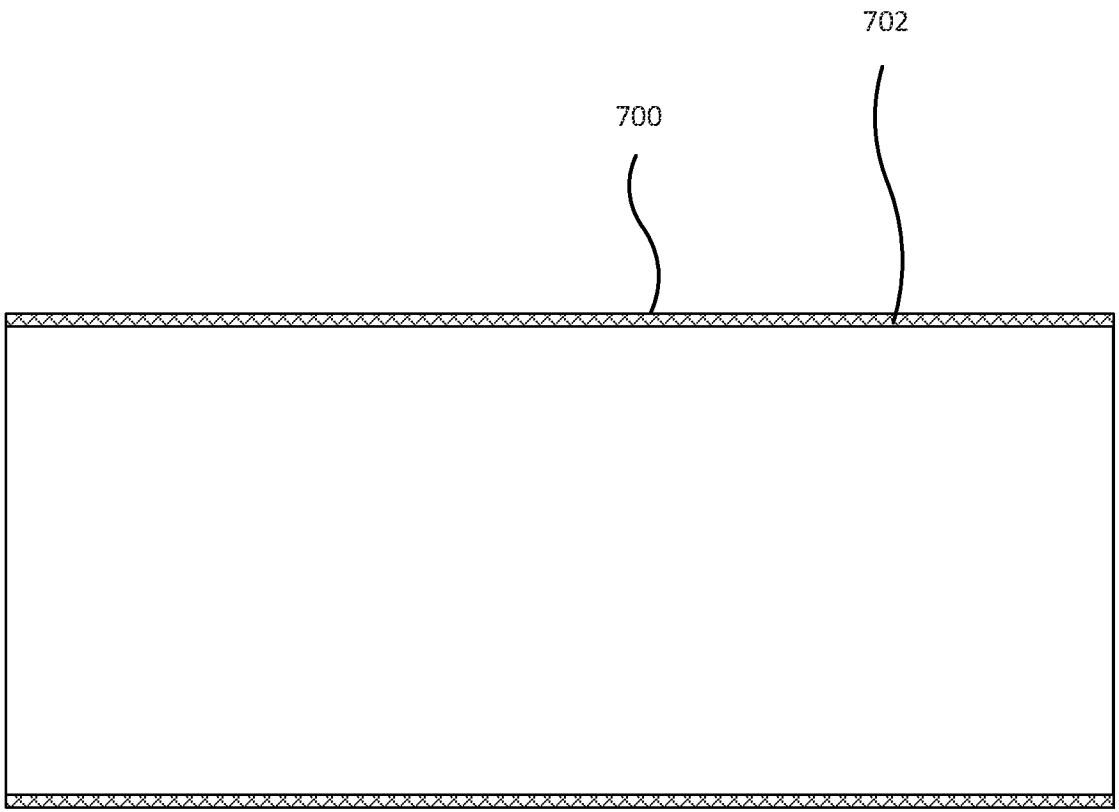
FIG. 7 is a top view of a metal ingot formed using the metal casting system of FIG. 1 after rolling techniques have been performed on the ingot, according to various embodiments.

The metal casting system 100 of FIGS. 1 and 6 can be used to produce a metal ingot 700 (e.g., FIG. 7). The metal ingot 700 can have an oxide layer 702, similar to or the same as the oxide layer 208 shown in FIG. 3. The metal ingot 700 can have the oxide layer 702 scraped or scalped using processes similar to or the same as processes used to scrape or scalp the metal ingot 206 shown in FIG. 4. The metal ingot 700 can be rolled (e.g., hot or cold rolled) similar to or the same as the rolling of metal ingot 206 shown in FIG. 5. However, unlike FIG. 5, the oxide layer 702 at the edges of the metal ingot 700 in FIG. 7 has not broken off and been pushed to a face of the ingot, nor formed a sliver 209. Using the magnetic rotors 104, the intermetallics can be reduced (or prevented from forming) in the metal ingot 700, allowing the oxide layer 702 to remain attached to the corners of the metal ingot during rolling operations and/or allowing avoidance of formation of slivers 209 during rolling operations.

Figure 8A:
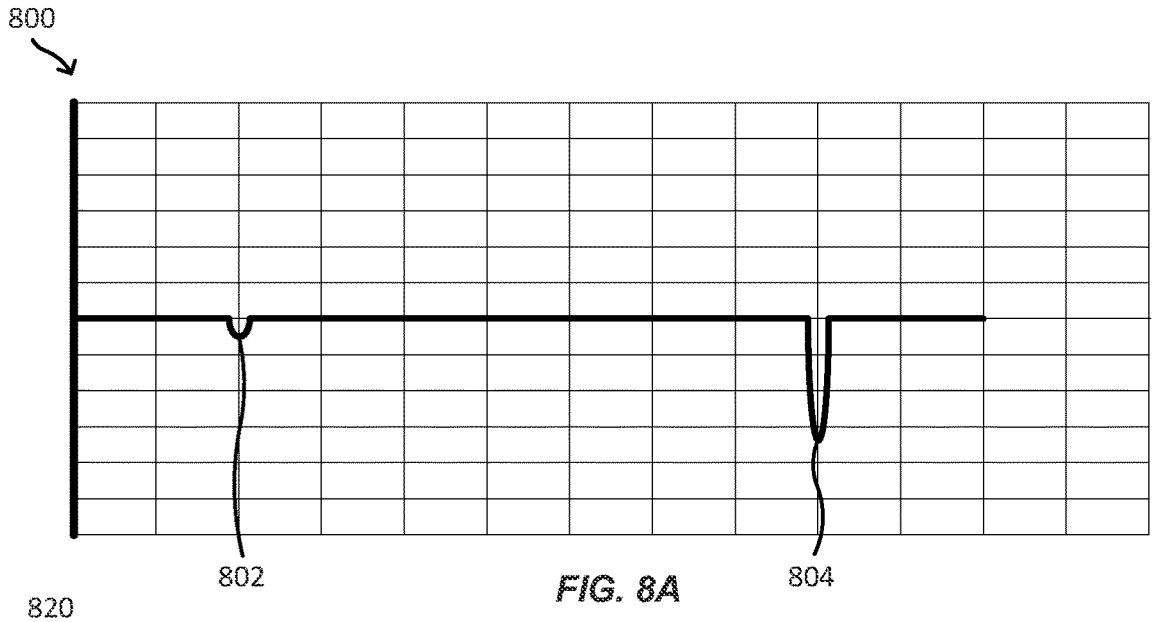
FIGS. 8A through 8C are graphs showing a profile of the molten metal in the mold of FIG. 1, according to various embodiments.
Figure 8B:
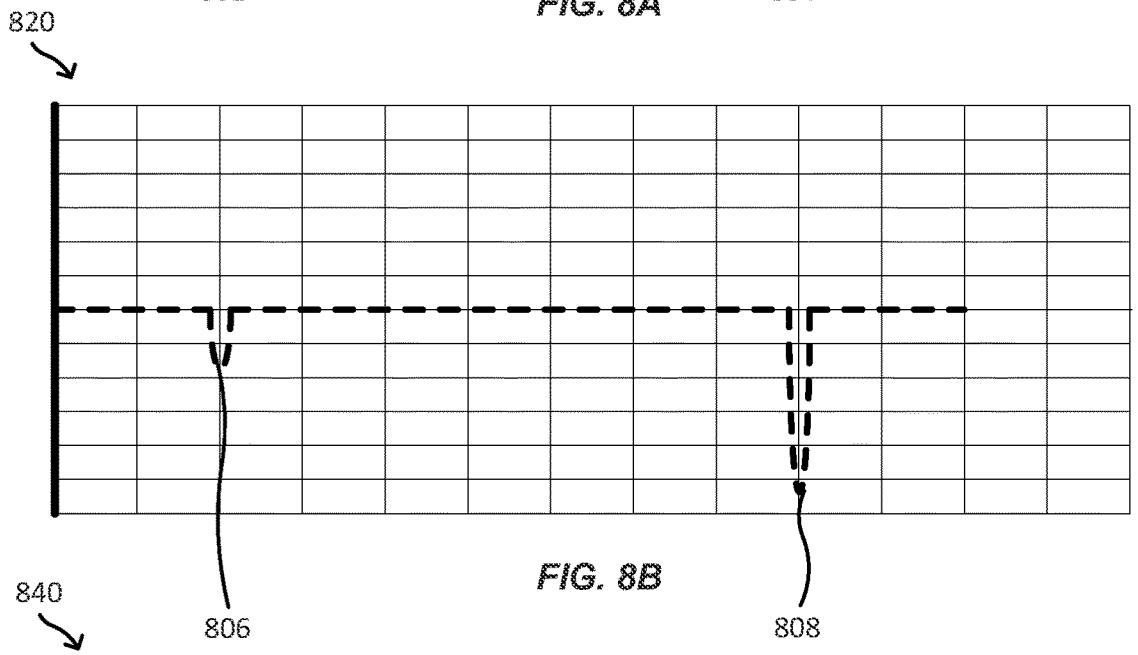
Figure 8C:
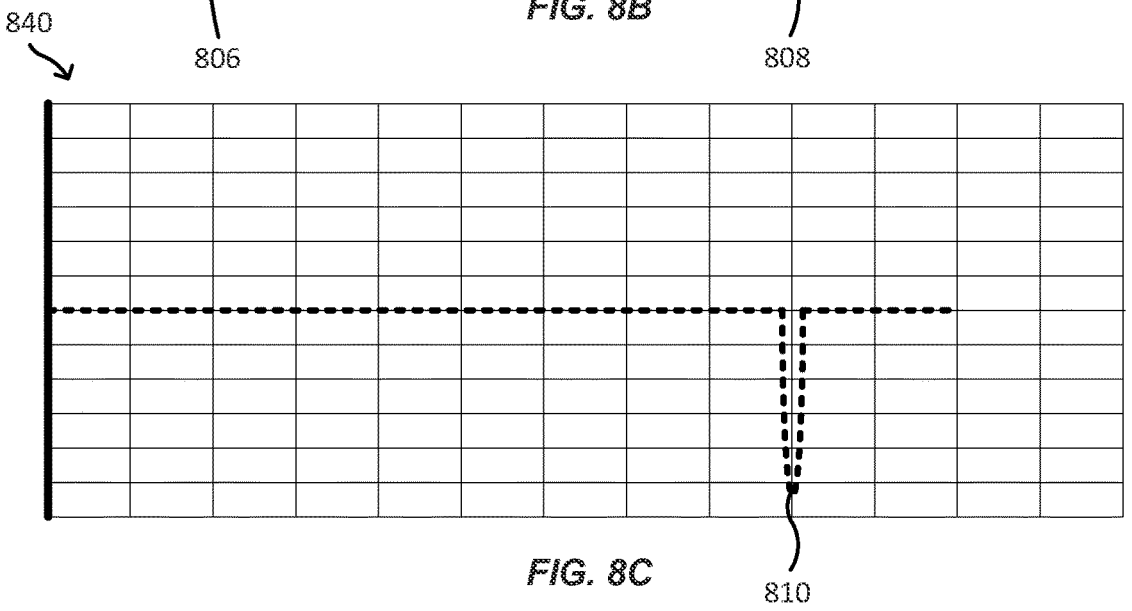

Turning to FIGS. 8A through 8C, profiles 800, 820, and 840, respectively, are shown. The profiles 800, 820, 840 can depend on different speeds of rotation of the magnetic rotors 104, however, the profiles may additionally or alternatively depend on the angle of the rotational axis 136, the number of magnetic rotors, the strength of the magnets 124, the number of permanent magnets, or combinations of these or other factors.

FIG. 8A illustrates an example of a profile 800 of a molten metal system without magnetic rotors 104. Generally, the profile 800 is depicted relative to a vertical axis that denotes Second derivative of Differential Scanning calorimeter scan (e.g., in W/g ° C.2) and a horizontal axis that denotes Temperature (° C.). The profile 800 can include two peaks 802, 804 at 590° C. and 515° C. The peaks can indicate the type and size of particles that are precipitating or dissolving (e.g., shown by the temperature at the peak) and the amount of precipitation or dissolution (e.g., the area under the peak).

FIG. 8B illustrates an example of a profile 820 of a molten metal system with magnetic rotors 104 rotating at a rotation speed in the range of 100 to 200 RPMs, and FIG. 8C illustrates an example of a profile 820 of a molten metal system with magnetic rotors 104 rotating at a rotation speed in the range of 250 to 350 RPMs. As may be appreciated by comparing FIG. 8A with FIG. 8B and FIG. 8C, the profile 820 of FIG. 8B can have peaks 806, 808 with a larger magnitude than those of profile 800 of FIG. 8A, while the profile 840 of FIG. 8C can have a single peak 810 that is larger than the corresponding peak 804 of FIG. 8A. Thus, changing the rotation speed of the magnetic rotors 104 can affect the magnitude of the peaks. The magnetic rotors 104 rotating at a certain rotation speed may cause the magnitude of the peaks to increase (e.g., peaks 806, 808, and 810) or may cause the magnitude of peaks to decrease (e.g., as shown in FIG. 8C where one of the peaks has been eliminated). The changing size of the peaks may indicate the amount of precipitation or dissolution changing due to the area of the peak changing. Similarly, the changing peak can indicate the size and type of particles that are precipitating or dissolving may be changing due to the temperature at the peak changing.

Figure 9:
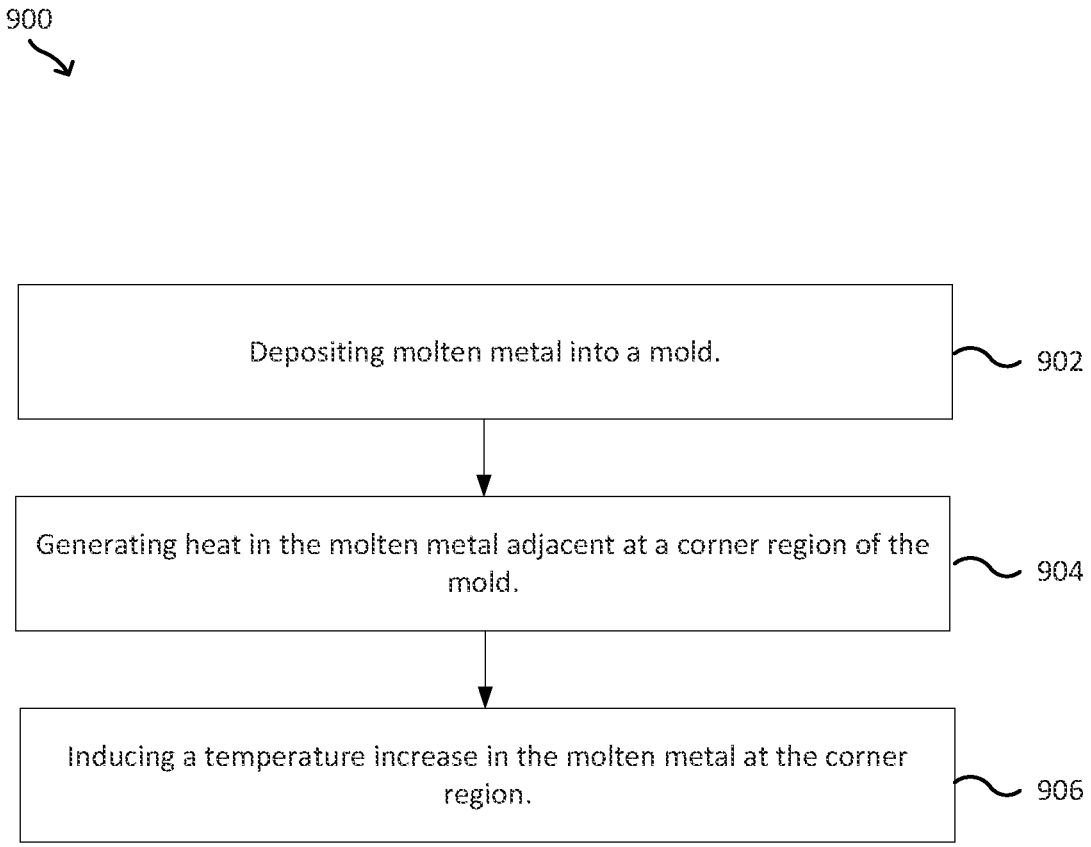
FIG. 9 is a flow chart illustrating a process of heating molten metal using the metal casting system of FIG. 1, according to various embodiments.

Turning to FIG. 9, a flowchart illustrating a process 900 of processing molten metal 110 using the metal casting system 100 of FIG. 1 is shown, according to various embodiments. Various blocks of the process 900 are described by referencing the components shown in FIGS. 1 and 6, however, additional or alternative components may be used with the process.

The process 900 at block 902 can include depositing molten metal (e.g., molten metal 110) into a mold (e.g., mold 102). The molten metal 110 can be deposited into the mold 102 through the mold opening 108. A bottom block 116 of the mold 102 can be in a position to form a bottom of the mold 102 for receiving the molten metal 110. The molten metal 110 can be deposited into the mold 102 from a launder 112 or other structure positioned above the mold.

The process 900 at block 904 can include generating heat in the molten metal 110 at a corner region 600 of the mold 102. The heat can be generated using magnetic rotors (e.g., magnetic rotors 104) positioned above the molten metal 110 in the corner region 600. The magnetic rotors 104 can generate changing magnetic fields 134 in the molten metal 110. The changing magnetic fields can in turn induce current 610 (e.g., eddy currents) in the molten metal 110. The current 610 can generate heat and induce flow of the molten metal in the corner region 600 and/or at the contact region 616. The generated heat and induced flow can heat the molten metal 110 to a temperature above the temperature at which the intermetallics can form (e.g., 515 degrees Celsius for certain alloys). The effect of the magnetic rotors 104 can be localized to the corner region 600 and/or the contact region 616. For example, the magnetic rotors 104 can cause the temperature of the molten metal 110 in the corner region 600 and/or the contact region 616 to rise with minimal or no effect to the molten metal outside of the corner region 600 and/or the contact region 616.

The process 900 at block 906 can include inducing a temperature increase in the molten metal 110 adjacent to the corner region 600. The temperature increase at block 906 may result from the heat generated at block 904. For example, the temperature increase can be caused by the heat generated and the flow induced by the current 610 induced by the magnetic rotors 104. In various embodiments, the temperature increase can be localized to the corner region 600 and/or the contact region 616. The temperature increase can heat the molten metal in the corner region 600 and/or the contact region 616 to a temperature that prevents intermetallics from forming. For example, the temperature in the corner region 600 and/or the contact region 616 can be increased to a temperature at or above 515 degrees Celsius or other suitable temperature, depending on the alloy being cast.

As used herein, the terms "invention," "the invention," "this invention," and "the present invention" are intended to refer broadly to all of the subject matter of this patent application and the claims below. Statements containing these terms should be understood not to limit the subject matter described herein or to limit the meaning or scope of the patent claims below. The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. As used herein, the meaning of "a," "an," and "the" includes singular and plural references unless the context clearly dictates otherwise.

While certain aspects of the present disclosure may be suitable for use with any type of material, such as metal, certain aspects of the present disclosure may be especially suitable for use with aluminum.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

ILLUSTRATIVE ASPECTS

All patents, publications and abstracts cited above are incorporated herein by reference in their entirety. The foregoing description of the embodiments, including illustrative aspects of embodiments, has been presented only for the purpose of illustration and description and is not intended to be exhaustive or limiting to the precise forms disclosed. Numerous modifications, adaptations, and uses thereof will be apparent to those skilled in the art.

Aspect 1 is an apparatus comprising: a mold comprising mold walls defining an opening for accepting molten metal, wherein an intersection of the mold walls at least partially define a corner region of the opening; a magnetic rotor adjacent to the corner region, wherein the magnetic rotor is: oriented to rotate one or more permanent magnets around a rotational axis that is perpendicular to a top face of the mold, positioned at a height above the molten metal when the molten metal is within the opening defined by the mold, and is configured to induce a current in the molten metal within the corner region to heat the molten metal within the corner region to a temperature that inhibits formation of intermetallics.

Aspect 2 is the apparatus of aspect(s) 1 (or of any other preceding or subsequent aspects individually or in combination), wherein the temperature is above 515 degrees Celsius.

Aspect 3 is the apparatus of aspect(s) 1 (or of any other preceding or subsequent aspects individually or in combination), wherein the intersection of the mold walls defines a rounded interior face and heating of the molten metal within the corner region is localized to a region between the rounded interior face and 50 mm from the rounded interior face.

Aspect 4 is the apparatus of aspect(s) 1 (or of any other preceding or subsequent aspects individually or in combination), wherein the magnetic rotor has a circular cross-section having a first radius and the intersection of the mold walls has an interior face with a second radius that is larger than or equal to the first radius.

Aspect 5 is the apparatus of aspect(s) 1 (or of any other preceding or subsequent aspects individually or in combination), wherein the magnetic rotor is operable to rotate one or more permanent magnets around a rotation axis at a speed in a range of 100 revolutions per minute (RPM) to 400 RPM.

Aspect 6 is the apparatus of aspect(s) 5 (or of any other preceding or subsequent aspects individually or in combination), wherein the magnetic rotor is operable to rotate one or more permanent magnets around a rotation axis at a speed of 180 RPM.

Aspect 7 is the apparatus of aspect(s) 1 (or of any other preceding or subsequent aspects individually or in combination), wherein the magnetic rotor is a first magnetic rotor, the corner region is a first corner region, the height is a first height, and the apparatus further comprises a second magnetic rotor adjacent a second corner region at a second height above the molten metal.

Aspect 8 is the apparatus of aspect(s) 1 (or of any other preceding or subsequent aspects individually or in combination), wherein heating of the molten metal is limited to the corner region and does not heat the molten metal near a center of the mold.

Aspect 9 is a system comprising: a mold comprising two or more sidewalls defining an opening for accepting molten metal, wherein two of the two or more sidewalls further define a corner region; a motor coupled with a drive shaft and positioned above the molten metal and adjacent to the corner region, wherein the motor is configured to rotate the drive shaft; and a magnetic source coupled with the drive shaft and configured to generate current in the molten metal in the corner region to heat the molten metal in the corner region to a temperature that inhibits formation of intermetallics, wherein the magnetic source is configured to localize heating to the molten metal in the corner region and not heat the molten metal at a center of the mold.

Aspect 10 is the system of aspect(s) 9 (or of any other preceding or subsequent aspects individually or in combination), wherein the temperature is above 515 degrees Celsius.

Aspect 11 is the system of aspect(s) 9 (or of any other preceding or subsequent aspects individually or in combination), wherein the magnetic source comprises one or more permanent magnets rotatable around a rotation axis perpendicular to a top face of the mold and defined by the drive shaft.

Aspect 12 is the system of aspect(s) 11 (or of any other preceding or subsequent aspects individually or in combination), wherein at least one of the one or more permanent magnets is fixedly attached to the drive shaft or mounted to the drive shaft to spin freely.

Aspect 13 is the system of aspect(s) 9 (or of any other preceding or subsequent aspects individually or in combination), wherein the two or more sidewalls form a rounded interior face having a first radius, the magnetic source has a circular cross-section having a second radius that is smaller than or equal to the first radius, and the magnetic source is positioned adjacent to the rounded interior face and within the opening.

Aspect 14 is the system of aspect(s) 9 (or of any other preceding or subsequent aspects individually or in combination), wherein the two or more sidewalls are stationary and the mold further comprises a bottom block lowerable to support the molten metal as it solidifies into a solidifying ingot.

Aspect 15 is a method comprising: depositing molten metal into a mold opening defined by two or more mold walls that further define at least one corner region; and generating current in the molten metal in the corner region to heat the molten metal in the corner region by rotating at least one magnetic rotor around an axis perpendicular to a top face of the mold, the at least one magnetic rotor positioned adjacent to the corner region and above the molten metal, wherein the molten metal within the corner region is heated to a temperature that inhibits formation of intermetallics.

Aspect 16 is the method of aspect(s) 15 (or of any other preceding or subsequent aspects individually or in combination), wherein operating the at least one magnetic rotor comprises rotating one or more permanent magnets around a rotation axis.

Aspect 17 is the method of aspect(s) 16 (or of any other preceding or subsequent aspects individually or in combination), wherein rotating the one or more permanent magnets comprises rotating the permanent magnets at a speed in a range of 100 revolutions per minute (RPM) to 400 RPM around the rotation axis.

Aspect 18 is the method of aspect(s) 16 (or of any other preceding or subsequent aspects individually or in combination), wherein the current is caused by changing magnetic fields induced in the molten metal in the corner region by rotating the one or more permanent magnets.

Aspect 19 is the method of aspect(s) 15 (or of any other preceding or subsequent aspects individually or in combination), wherein the temperature that inhibits formation of intermetallics is above 515 degrees Celsius.

Aspect 20 is the method of aspect(s) 15 (or of any other preceding or subsequent aspects individually or in combination), wherein the at least one magnetic rotor is positioned to cause heating localized in the corner region with minimal heating outside of the corner region.

What is claimed is:

1. An apparatus comprising:

a mold comprising mold walls defining an opening for accepting molten metal, wherein an intersection of the mold walls at least partially defines a corner region of the opening; and a magnetic rotor adjacent to the corner region, wherein the magnetic rotor is:

oriented to rotate one or more permanent magnets around a rotational axis that is perpendicular to a top face of the mold, positioned at a height above the molten metal when the molten metal is within the opening defined by the mold, and configured to induce a current in the molten metal within the corner region to heat the molten metal within the corner region to a temperature that inhibits formation of intermetallics.

2. The apparatus of claim 1, wherein the magnetic rotor is a first magnetic rotor, the corner region is a first corner region, the height is a first height, and the apparatus further comprises a second magnetic rotor adjacent a second corner region at a second height above the molten metal.

3. The apparatus of claim 1, wherein the intersection of the mold walls defines a rounded interior face and heating of the molten metal within the corner region is localized to a region between the rounded interior face and 50 mm from the rounded interior face.

4. The apparatus of claim 1, wherein the magnetic rotor has a circular cross-section having a first radius and the intersection of the mold walls has an interior face with a second radius that is larger than or equal to the first radius.

5. The apparatus of claim 1, wherein the magnetic rotor is operable to rotate one or more permanent magnets around a rotation axis at a speed in a range of 100 revolutions per minute (RPM) to 400 RPM.

6. The apparatus of claim 5, wherein the magnetic rotor is operable to rotate the one or more permanent magnets around a rotation axis at a speed of 180 RPM.

7. The apparatus of claim 1, wherein heating of the molten metal is limited to the corner region and does not heat the molten metal near a center of the mold.

8. The apparatus of claim 1, wherein the temperature is above 515 degrees Celsius.

9. A system including the apparatus of claim 1, the system further comprising:

a drive shaft coupled with the magnetic rotor and configured to rotate the one or more permanent magnets around the rotational axis; and a motor coupled with the drive shaft, the motor configured to, using the drive shaft, rotate the magnetic rotor to induce the current in the molten metal within the corner region.

10. The system of claim 9, wherein two or more of the mold walls form a rounded interior face having a first radius, the magnetic rotor has a circular cross-section having a second radius that is smaller than or equal to the first radius, and the magnetic rotor is positioned adjacent to the rounded interior face and within the opening.

11. The system of claim 9, wherein the mold walls are stationary and the mold further comprises a bottom block lowerable to support the molten metal as it solidifies into a solidifying ingot.

12. The system of claim 9, wherein the magnetic rotor comprises one or more permanent magnets fixedly attached to the drive shaft or mounted to the drive shaft to spin freely.

13. A method of using the apparatus of claim 1, the method comprising:

depositing the molten metal into the mold opening; and generating the current in the molten metal in the corner region to heat the molten metal in the corner region to the temperature that inhibits formation of the intermetallics by rotating the magnetic rotor around the rotational axis.

14. The method of claim 13, wherein the current is caused by changing magnetic fields induced in the molten metal in the corner region by rotating the one or more permanent magnets.

15. The method of claim 13, wherein the magnetic rotor is positioned to cause heating localized in the corner region with minimal heating outside of the corner region.

* * * * *